United States Patent [19]

Hirai et al.

[11] Patent Number: 4,514,493

[45] Date of Patent: Apr. 30, 1985

[54] HEAT-DEVELOPABLE LIGHT-SENSITIVE MATERIAL WITH BASE PRECURSOR PARTICLES

[75] Inventors: Hiroyuki Hirai; Kozo Sato; Ken Kawata, all of Kanagawa, Japan

[73] Assignee: Fuji Photo Film Co., Ltd., Kanagawa, Japan

[21] Appl. No.: 592,197

[22] Filed: Mar. 22, 1984

[30] Foreign Application Priority Data

Mar. 25, 1983 [JP] Japan ..... 58-50000

[51] Int. Cl.[3] ..... G03C 1/06; G03C 5/24

[52] U.S. Cl. ..... 430/617; 430/203; 430/353; 430/495; 430/619; 430/955

[58] Field of Search ..... 430/203, 351, 353, 617, 430/619, 955, 495

[56] References Cited

U.S. PATENT DOCUMENTS 3,220,846 11/1965 Tinker et al. ..... 430/350

4,430,415 2/1984 Aono et al. ..... 430/203

*Primary Examiner*—Richard L. Schilling

*Attorney, Agent, or Firm*—Sughrue, Mion, Zinn, Macpeak & Seas

[57] ABSTRACT

A heat-developable light-sensitive material is described, which contains fine particles of a substantially water-insoluble base precursor incorporated in a binder. This light-sensitive material is superior in stability with the passage of time and the changes on the photographic characteristics such as maximum density, minimum density and sensitivity are less during the storage thereof.

4 Claims, No Drawings

HEAT-DEVELOPABLE LIGHT-SENSITIVE MATERIAL WITH BASE PRECURSOR PARTICLES

FIELD OF THE INVENTION

The present invention relates to a heat-developable light-sensitive material and a process for preparing the same. More particularly, the present invention relates to a heat-developable light-sensitive material containing a base precursor which is substantially insoluble in water.

BACKGROUND OF THE INVENTION

In many cases, a heat developable light-sensitive material contains a base or a base precursor in the light-sensitive material to accelerate heat development. From a viewpoint of storage stability of the light-sensitive material, use of a base precursor releasing a basic substance by thermal decomposition is more preferred.

Typical examples of the base precursor are described in British Pat. No. 998,949. Preferred base precursor is a salt of a carboxylic acid and an organic base. Examples of useful carboxylic acid are trichloroacetic acid and trifluoroacetic acid, and examples of useful base are guanidine, piperidine, morpholine, p-toluidine, and 2-picoline. Particularly useful base precursor is guanidine trichloroacetate as described in U.S. Pat. No. 3,220,846. Further, aldoneamides described in Japanese Patent Application (OPI) No. 22625/75 (the term "OPI" as used herein means a "published unexamined Japanese patent application") decompose at high temperatures to release a base, and are preferably used.

Of the base precursors described above, water-soluble base precursors, however, have a disadvantage such that they are easily changeable on reacting with other components contained in coating materials. Furthermore, since those water-soluble base precursors are added in the form of an aqueous solution, those are uniformly present in the coating and are readily affected by air or moisture. Hence, the water-soluble base precursors are decomposed under the action of air or moisture to change photographic characteristics of the light-sensitive material, thereby deteriorating the storage stability of the light-sensitive material.

Water-insoluble base precursors have heretofore been used in the manner such that these are first dissolved in an organic solvent which is compatible with water, such as methanol, ethanol, acetone, or dimethylformamide, and then the resulting solution is added to an emulsion layer and/or its adjacent layer of the light-sensitive material. This is an industrially convenient method to introduce a water-insoluble additive into the light-sensitive material. In the method, however, the amount of the solvent which can be introduced into the light-sensitive material is limited. No serious problem arises when the amount of the additive added is small but in the case of the base precursor which must be added in a large amount, the amount of organic solvent which is required to dissolve therein the base precursor often exceeds the upper limit. Furthermore, many base precursors are sparingly soluble in such organic solvent which is compatible with water and those are difficult to add to the light-sensitive material.

SUMMARY OF THE INVENTION

An object of the present invention is to provide a heat-developable light-sensitive material which uses a substantially water-insoluble base precursor.

Another object of the invention is to provide a heat-developable light-sensitive material having an excellent stability with the passage of time.

The stability with the passage of time used herein means that during the storage of a light-sensitive material prior to a heat development treatment, the changes of photographic characteristics such as maximum density, minimum density, sensitivity, etc. are small.

The objects of the present invention can be attained by incorporating fine particles of a substantially water-insoluble base precursor into a binder.

The present invention relates to a heat-developable light-sensitive material which contains fine particles of a substantially water-insoluble base precursor in a binder.

DETAILED DESCRIPTION OF THE INVENTION

The fine particles of the substantially water-insoluble base precursor as used herein have an average particle diameter ranging from 0.01 to 50 $\mu$m, preferably from 0.05 to 5 $\mu$m.

In the heat-developable light-sensitive material of the present invention, the substantially water-insoluble base precursor is locally present in the binder and this prevents the base precursor from decomposition and release of a base during the storage of the light-sensitive material. As a result, the storage stability of the light-sensitive material is improved.

On the other hand, water-soluble base precursors tend to react with other additives in the light-sensitive material, deteriorating the storage stability of the light-sensitive material. Also, in the case that the base precursors are dispersed in the binder by adding in the form of an aqueous solution thereof, for example, the bases tend to be released by the influences of air or humidity, deteriorating the storage stability of the light-sensitive material. The light-sensitive material of the present invention is free from the above described disadvantages and exhibits extremely excellent performances.

The term "base precursor" as used herein means a compound which releases a basic component by thermal decomposition. Further, the "substantially water-insoluble base precursor" as used herein is preferably a base precursor having a solubility of 1% by weight or less in water at 20° C.

The base precursor may be present in any position of the light-sensitive material (e.g., an intermediate layer, a protective layer, on an emulsion layer) so long as it can chemically participate in a silver halide at the time of heating and can accelerate development. It is however preferred to incorporate the base precursor in either a silver halide emulsion layer or its adjacent layer.

Any base precursor can be used in the present invention so long as it is substantially insoluble in water.

Representative examples of the base precursor are shown below although the present invention is not limited thereto.

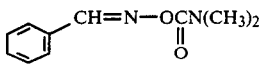
(1)
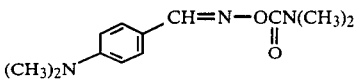
(2)
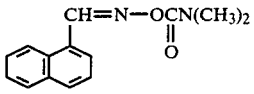
(3)
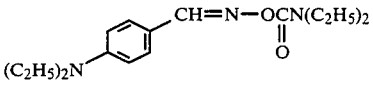
(4)
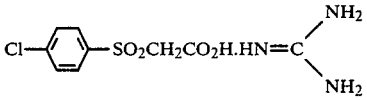
(5)
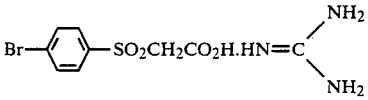
(6)
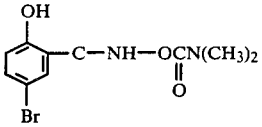
(7)
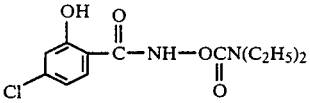
(8)
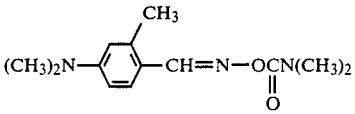
(9)
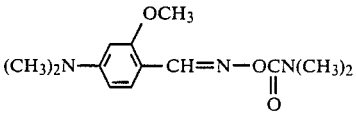
(10)
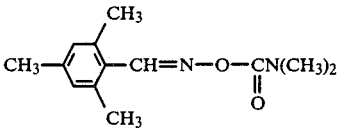
(11)
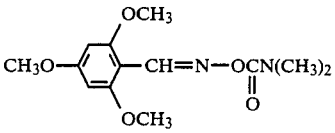
(12)
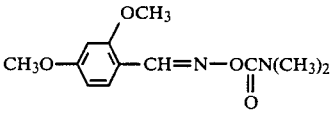
(13)
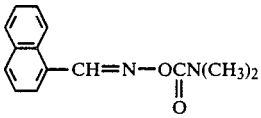
(14)
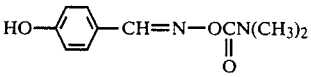
(15)
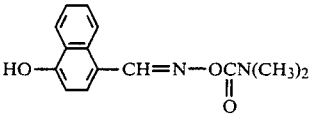
(16)
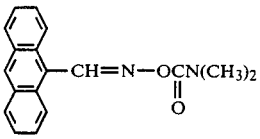
(17)
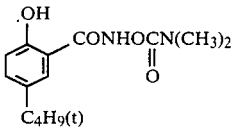
(18)
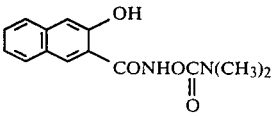
(19)
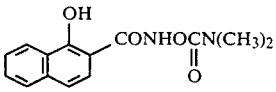
(20)
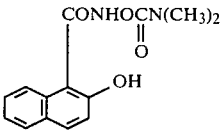
(21)
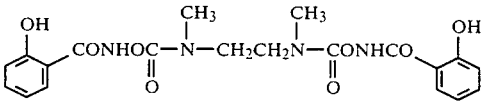
(22)
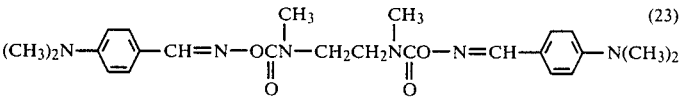
(23)
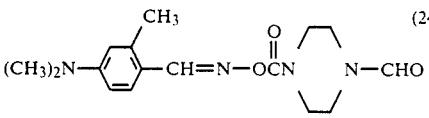
(24)

-continued (25)

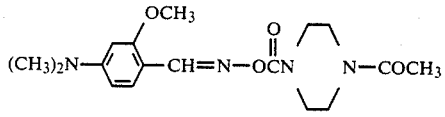

(26)

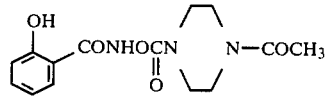

(27)

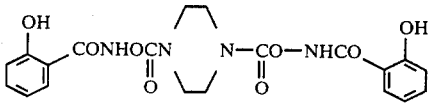

(28)

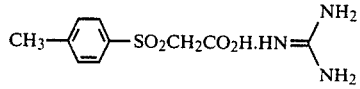

(29)

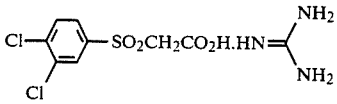

(30)

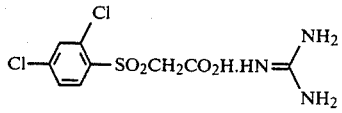

(31)

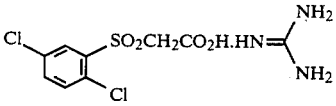

(32)

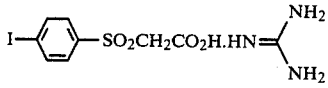

(33)

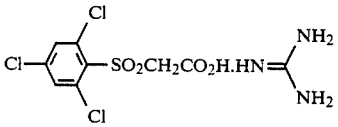

(34)

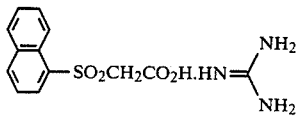

(35)

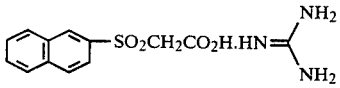

(36)

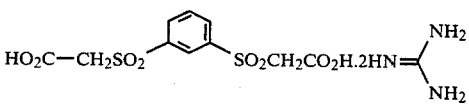

(37)

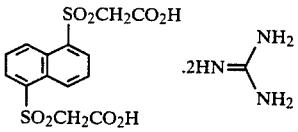

(38)

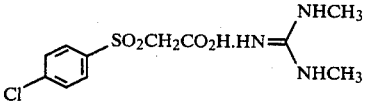

(39)

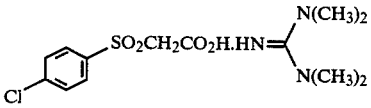

(40)

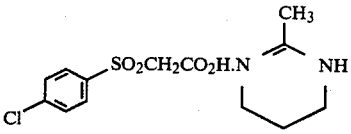

These base precursors may be used alone or in any mixture thereof. At least one of these dispersions can be incorporated into the composition of the light-sensitive material layer. Furthermore, those can be used in combination with other base precursors which are soluble in water or organic solvents compatible with water.

The amount of the base precursor incorporated in the light-sensitive material can be chosen within a wide range. The preferred amount thereof is 50% by weight or less and the most preferred amount is 0.01 to 40% by weight, based on the weight of the coating layer.

The base precursor is preferably added to a layer of the light-sensitive material in the manner such that its aqueous dispersion be first prepared and then added to a dispersion solution for coating. However, the fine particles of the base precursor may be directly incorporated into the coating solution and also may be added in the form that water is removed from the above aqueous dispersion.

The above-described aqueous dispersion preferably contains a dispersing agent. Useful examples of the dispersing agent include derivatives of urea and thiourea as described in Japanese Patent Application (OPI) No. 102733/78; saturated or unsaturated mono- or dicarboxylic acid amides; lactams; acid imides or their derivatives; oxims; saturated or unsaturated 5- or 6-membered heterocyclic compounds containing O, S, CO or NH in the ring and substituted with OH, $NH_2$, halogen, alkyl (preferably having 1 to 4 carbon atoms), phenyl, or hydroxyalkyl (preferably having 1 to 3 carbon atoms); at least dihydric (polyhydric) aliphatic or aromatic alcohols; polyalkylene glycols; carbamic acid esters; benzene derivatives; and alkylaryl sulfonates of monomers, oligomers and polymers, containing at least 18 carbon atoms, as described in Japanese Patent Application (OPI) No. 110012/77.

Of these compounds, at least dihydric (polyhydric) aliphatic alcohols and polyalkylene glycols are especially preferred. Typical examples thereof are sorbitol, manitol, o-xylene glycol, erythritol, D-fructose, maltose, lactose, and polyethylene glycols having a molecular weight of from 500 to 20,000.

The amount of the dispersing agent added is preferably 80% by weight or less based on the weight of the aqueous dispersion.

The above-described aqueous dispersion preferably contains a wetting agent. Useful examples of the wetting agent include nonionic surface active agents, such as alkyl polyglycol ethers, alkylphenyl polyglycol ethers, and fatty acid polyglycol esters, as described in Japanese Patent Application (OPI) No. 102733/78; and anionic surface active agents, such as sulfonated primary or secondary aliphatic alcohols containing 8 to 18 carbon atoms, sulfonated unsaturated fatty acids, sulfonated fatty acid amides, sulfonated alkyleneoxy adducts, sulfonated partially esterified polyhydric alcohols, alkyl sulfonates, naphthene sulfonates, olefin sulfonates, mersolates, sodium dialkylsulfosuccinate, taurides, alkylaryl sulfonates, mono- or di-alkylnaphthalene sulfonates, naphthalenesulfonic acid/formaldehyde condensates, lignin sulfonates, oxylignin sulfonates, sulfonates of polycarboxylic acid esters and polycarboxylic acid amides, fatty acid/aminoalkyl sulfonate condensates, and phosphated surface active agents. Of these compounds, nonionic surface active agents such as alkyl polyglycol ethers, alkylphenyl polyglycol ethers, and fatty acid polyglycol esters are especially preferred.

In addition, nonionic surface active agents described in *Surfactant Science Series, Vol. I, Nonionic Surfactants,* (edited by Martin J. Schick), Marcel Dekker Inc. (1967 and Cchoufeldt. N, *Surface Active Ethylene Oxide Adducts,* Pergamon Press Co. (1969) are also useful.

The amount of the wetting agent added is preferably 50% by weight of less based on the weight of the aqueous dispersion.

The aqueous dispersion used in the present invention contains a binder. Useful examples of the binder are hydrophilic colloids, such as proteins (e.g., gelatin, gelatin derivatives, and cellulose derivatives), natural substances (e.g., polysaccharides such as starch and gum arabic), water soluble polyvinyl compounds (e.g., polyvinyl pyrrolidone and polyacrylamide), and dispersed vinyl compound latexes. Of these compounds, gelatin is especially preferred.

The amount of the binder used is preferably 10% by weight or less based on the weight of the aqueous dispersion.

Fine particles of the substantially water-insoluble base precursor are produced by using a suitable mill. It is required for the mill to have a shearing force sufficient to divide the precursor to a necessary particle diameter within a suitable time.

Examples of suitable mills for use in the present invention are shown below.

(1) Sand mill manufactured by P. Vollrath, Maschinenfabriken Köln (2) Beat mill manufactured by Drarswerke Gmbh, Manheim (3) Dyno mill manufactured by W. A. Bachofen, Maschinenfabriken, Basel (4) Masap mill manufactured by Masap AG Matzendorf Shweiz (5) Homogenizer manufactured by Nippon Seiki Seisakujo A grinding method and suitable mills are described in U.S. Pat. Nos. 2,581,414, 2,855,156, and Japanese Patent Application (OPI) No. 10012/77.

The grinding method of the base precursor will hereinafter be explained briefly.

A container wherein the base precursor is ground is placed in a cooling jacket and cooled with a cooling liquid during grinding. This cooling liquid (e.g., a flowing water) is used in an amount substantially sufficient to completely remove the heat generated by grinding and also to keep the temperature of the base precursor at temperatures not exceeding 40° C. during grinding. The average diameter of a grinding element (e.g., glass beads) is determined by the particle diameter of the base precursor. Preferred average particle diameter of the base precursor to be ground is $\frac{2}{3}$ time or less the diameter of the grinding element.

If the average particle diameter of the base precursor to be ground is more than of $\frac{2}{3}$ time the diameter of the grinding element, it is preferred for the base precursor to previously reduce its diameter by the conventional method. The amount of the grinding element is at least about 3 or 4 times the amount of the base precursor to be ground. As the grinding element, other than glass beads, quartz sand and silicon carbide sand can be used.

The aqueous dispersion used in the present invention is prepared, for example, in the following procedure.

20 g of a base precursor to be ground is mixed with 100 g of glass beads (for example, Mahlkorper MK 3GK; diameter: 0.5–0.75 mm). The average diameter of the beads is, as described above, determined by the particle diameter of the base precursor. Additionally, 50 ml of water and 10 ml of a 10 wt% aqueous solution of a dispersing agent are added. The resulting mixture is then ground. The inner temperature of the mill is maintained at a temperature not exceeding 40° C. The contents of the mill is filtered by passing through a filter having apertures of suitable size to separate the glass beads.

If necessary, a wetting agent and/or a binder may be added while grinding or after grinding or to a filtrate (aqueous dispersion) obtained by the filtration.

If the substantially water-insoluble base precursor is of the acid-base type, its aqueous dispersion can be prepared by a method described below.

First, an acid and a base are dissolved separately. In this case, at least one of the solvents for use in dissolving the acid and base is desired to be water. Then, the thus separately formed solutions are mixed in the presence of a dispersing agent and, if necessary, in the presence of a wetting agent and/or a binder to form the desired aqueous dispersion. Organic solvents which are used herein are desirably solvents which are compatible with water, such as methanol, ethanol, acetone, and dimethylformamide (DMF). In addition, solvents which are incompatible with water, such as ethyl acetate, butyl acetate, and cyclohexanone, can be also used.

It should be noted that the present invention is not limited to the above described methods only.

Regarding the method for removing water from the aqueous dispersion or drying the aqueous dispersion, any conventional methods and apparatuses can be employed. For example, the spray drying method and the freeze drying method described in Japanese Patent Application (OPI) No. 110012/77 can be employed.

The heat-developable light-sensitive material is known in the art of this field. The light-sensitive material and its process are described in, for example, *Shashin Kogaku No Kiso,* Corona Co., Ltd. (1979), pages 553–555, *Eizo Joho,* April 1978, page 40, *Nebletts Handbook of Photography and Reprography,* 7th ed., Van Nostrand Reinhold Co., pages 32–33, U.S. Pat. No. 3,152,904, 3,301,678, 3,392,020 and 3,457,075, British Pat. Nos. 1,131,108 and 1,167,777, and *Research Disclosure,* July, 1978, pages 9–15 (RD-17029).

Many techniques have been proposed to form color images by a dry system.

With respect to a process for forming color images by a coupling reaction of an oxidation product of developer and a coupler, U.S. Pat. No. 3,531,286 discloses p-phenylenediamines-based reducing agents and phenolic or active methylene couplers; U.S. Pat. No. 3,761,270, p-aminophenol-based reducing agents; Belgian Pat. No. 802,519 and *Research Disclosure,* September 1975, pages 31–32, sulfonamide-based reducing agents; and U.S. Pat. No. 4,021,240, a combination of sulfonamidophenol-based reducing agents and 4-equivalent couplers.

*Research Disclosure,* May 1978, pages 54–58 (RD-16966) discloses a process in which a nitrogen-containing heterocyclic group is introduced in a dye, a silver salt is formed and thereafter the dye is released by heat development.

With respect to a process for forming positive-working color images by the heat-sensitive silver dye bleaching process, useful dyes and bleaching techniques are described in, for example, *Research Disclosure,* April 1976, pages 30–32 (RD-14433), ibid., December 1976, pages 14–15 (RD-15227), and U.S. Pat. No. 4,235,957.

A process for forming color images utilizing leuco dye is described in, for example, U.S. Pat. Nos. 3,985,565 and 4,022,617.

The present invention is also applicable to light-sensitive materials containing dye releasing redox compounds which release a hydrophilic dye as described in European Patent Application Nos. 79 492A and 79 056A, and other various light-sensitive materials using base precursors.

The present invention is described in greater detail by reference to the following examples although it is not limited thereto. Unless otherwise indicated, all percents, parts, ratio and the like are by weight.

EXAMPLE 1

To 50 g of the water-insoluble base precursor (2) were added 400 g of water, 5 g of polyethylene glycol (average molecular weight: 2,000), and 50 g of gelatin (10% aqueous solution), and the resulting mixture was ground for 30 minutes in a mill containing 600 g of glass beads having an average diameter of about 0.6 mm. The particle diameter of the base precursor (2) before grinding was about 0.3 mm, and the particle diameter decreased to the average particle diameter of 1μ by the grinding process. The glass beams were separated by filtration to obtain an aqueous dispersion (c) of the base precursor (2).

This aqueous dispersion (c) was mixed with an emulsion (a) and a gelatin dispersion (b) of a coupler as described hereinafter and coated on a polyethylene terephthalate film in a wet thickness of 60 μm to form a light-sensitive material.

Preparation of Emulsion (a)

40 g of gelatin and 26 g of potassium bromide (KBr) were dissolved in 3,000 ml of water, and the resulting solution was stirred while maintaining the temperature at 50° C.

A solution prepared by dissolving 34 g of silver nitrate in 200 ml of water was added to the above prepared solution over 10 minutes and then, a solution prepared by dissolving 3.3 g of potassium iodide (KI) in 100 ml of water was added thereto over 2 minutes.

By controlling the pH of the thus prepared silver iodobromide emulsion, precipitates were formed and excess salts were removed. The pH was then adjusted to 6.0 and 400 g of the silver iodobromide emulsion was obtained.

Preparation of Gelatin Dispersion (b) of Coupler 5 g of 2-dodecylcarbamoyl-1-naphthol, 0.5 g of sodium 2-ethyl-hexylsuccinate sulfonate and 2.5 g of tricresyl phosphate (TCP) were weighed and dissolved in 30 ml of ethyl acetate. The thus prepared solution was mixed with 100 g of a 10% aqueous solution of gelatin and stirred to prepare a gelatin dispersion of a coupler.

(1) Silver iodobromide emulsion (a): 10 g
(2) Gelatin dispersion (b) of coupler: 3.5 g
(3) Aqueous dispersion (c): 4.5 g
(4) Gelatin (10% aqueous solution): 5 g
(5) 2,3-Dichloro-p-aminophenol: 0.2 g The above components were dissolved in 15 ml of water and the resulting mixture was coated on a support to form a light-sensitive material.

This light-sensitive material was imagewise exposed at 2,000 lux for 5 seconds using a tungsten lamp and then uniformly heated for 20 seconds on a heat block which had been heated at 150° C. A negative-working cyan color image was formed. The density was measured using a Macbeth transmission densitometer (TD-504). As the results, the maximum density was 2.08 and the minimum density was 0.25.

EXAMPLE 2

The same silver iodobromide emulsion (a) and aqueous dispersion (c) of the base precursor (2) as used in Example 1, and a dispersion (d) of a dye releasing compound as described hereinafter were used.

Preparation of Dispersion (d) of Dye Releasing Compound 5 g of a dye releasing compound having the following formula:

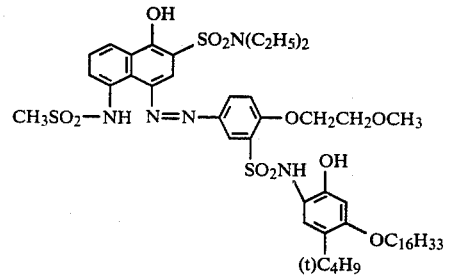

0.5 g of sodium 2-ethyl-hexylsuccinate sulfonate as a surface active agent, and 5 g of tricresyl phosphate (TCP) were weighed, added to 30 ml of ethyl acetate and dissolved therein by heating at about 60° C. This solution and 100 g of a 10% aqueous solution of gelatin were mixed and stirred, and then dispersed using a homogenizer at 10,000 rpm for 10 minutes.

(1) Silver iodobromide emulsion (a): 25 g
(2) Dispersion (d) of dye releasing redox compound: 33 g
(3) Aqueous dispersion (c): 40 g
(4) 10% Aqueous solution of $H_2NSO_2N(CH_3)_2$: 4 ml
(5) 5% Aqueous solution of compound having the following formula: 5 ml

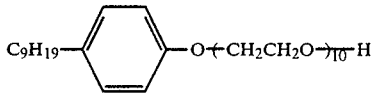

The above components (1) to (5) were mixed and dissolved by heating, and the resulting mixture was coated on a polyethylene terephthalate film in a wet thickness of 30 μm. After drying, the sample was imagewise exposed at 2,000 lux for 10 seconds using a tungsten lamp. The sample was then uniformly heated for 30 seconds on a heat block which had been heated at 150° C.

A method for the formation of an image-receiving material having an image-receiving layer is described below.

10 g of poly(methyl acrylate-co-N,N,N-trimethyl-N-vinylbenzylammonium chloride) (the ratio of methyl acrylate and vinylbenzylammonium chloride is 1:1) was dissolved in 200 ml of water and then uniformly mixed with 100 g of 10% aqueous solution of lime-treated gelatin. The thus prepared mixture was then coated on a paper support with titanium dioxide-dispersed polyethylene laminated thereon in a wet thickness of 90 μm and then dried to prepare an image-receiving material.

This image-receiving material was immersed in water and the above heated light-sensitive material was superposed on the image-receiving material in such a manner that the coatings of the materials were in contact with each other.

The laminate was heated for 6 seconds on a heat block which had been heated at 80° C. and the image-receiving material was peeled away from the light-sensitive material. A negative-working magenta color image was formed on the image-receiving material. The density of the negative-working image was measured with a Macbeth reflection densitometer (RD-519). As the result, the maximum density was 2.00 and the minimum density was 0.18.

This light-sensitive material was stored at 60° C. for 2 days and then processed in the same manner as above. The maximum density was 2.02 and the minimum density was 0.25. Thus, it was confirmed that the light-sensitive material had a good stability with the passage of time.

EXAMPLE 3

Aqueous dispersions were prepared in the same manner as in Example 1 except that the base precursor (2) was replaced by the base precursors as shown in Table 1.

The light-sensitive material and image-receiving material were prepared in the same manner as in Example 2 and heat developed under the conditions shown in Table 1. Thereafter, they were processed in the same manner as in Example 2. The density of the negative-working image on the image-receiving material was measured. The results obtained are shown in Table 1 below.

TABLE 1

| Base Precursor No. | Amount Added g | Heat Development Conditions: Temperature (°C.) | Heat Development Conditions: Time (sec) | Maximum Density | Minimum Density |
|---|---|---|---|---|---|
| (4) | 60 | 150 | 40 | 1.85 | 0.17 |
| (5) | 75 | 140 | 30 | 2.15 | 0.22 |
| (6) | 75 | 140 | 30 | 2.10 | 0.19 |
| (9) | 60 | 140 | 30 | 1.92 | 0.18 |
| (14) | 75 | 140 | 20 | 1.94 | 0.20 |
| (28) | 60 | 140 | 30 | 2.05 | 0.22 |

EXAMPLE 4

Preparation of Benzotriazole-Containing Silver Halide Emulsion 6.5 g of benzotriazole and 10 g of gelatin were dissolved in 1,000 ml of water. This aqueous solution was stirred while keeping at 50° C. A solution prepared by dissolving 8.5 g of silver nitrate in 100 ml of water was added to the aqueous solution over 2 minutes.

A solution prepared by dissolving 1.2 g of potassium bromide in 50 ml of water was added to the above solution over 2 minutes. By controlling the pH of the thus prepared emulsion, precipitates were formed and excess salts were removed. The pH of the emulsion was then adjusted to 6.0 and 200 g of the emulsion was obtained.

Preparation of Gelatin Dispersion of Dye Releasing Redox Compound 10 g of a dye releasing redox compound having the following formula:

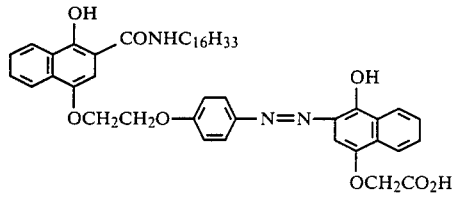

0.5 g of sodium 2-ethyl-hexylsuccinate sulfonate, and 4 g of tricresyl phosphate (TCP) were weighed and dissolved in 20 ml of cyclohexanone at about 60° C. to form a uniform solution. This solution was mixed with 100 g of a 10% aqueous solution of lime-treated gelatin. The resulting mixture was stirred and then dispersed using a homogenizer at 10,000 rpm for 10 minutes.

As the aqueous dispersion of the water-insoluble base precursor, the same dispersion as used in Example 1 was used.

(a) Silver benzotriazole emulsion containing light-sensitive silver bromide: 10 g
(b) Dispersion of dye releasing redox compound: 3.5 g
(c) Aqueous dispersion of base precursor (2) of the invention: 5 g
(d) Solution prepared by dissolving 200 mg of 2,6-dichloro-4-aminophenol in 2 ml of methanol The above components (a) to (d) were mixed and dissolved by heating, and the mixture was coated on a 180 μm thick polyethylene terephthalate film in a wet thickness of 30 μm.

The coated sample was dried and imagewise exposed at 2,000 lux for 10 seconds using a tungsten lamp. The sample was then uniformly heated for 30 seconds on a heat block which had been heated at 150° C.

As the image-receiving material, the same material as used in Example 2 was used.

Using the above light-sensitive and image-receiving materials, the procedure of Example 2 was repeated. A negative-working magenta color image was formed on the image-receiving material. The density of the negative-working image was measured with a Macbeth reflection densitometer (RD-519). The maximum density was 1.76 and the minimum density was 0.15.

EXAMPLE 5

A light-sensitive material was prepared in the same manner as in Example 4 except that 7 g of an aqueous dispersion of a water-insoluble base precursor (5) as described hereinafter was used in place of the aqueous dispersion used in Example 4.

Using this light-sensitive material, the procedure of Example 4 was repeated. A magenta color image was formed on the image-receiving material. The maximum density was 2.03 and the minimum density was 0.22.

Preparation of Aqueous Dispersion of Water-Insoluble Base Precursor (5)

10 g of polyethylene glycol (average molecular weight: 2,000) and 10 g of gelatin was dissolved in 500 ml of water. The thus prepared solution was stirred while keeping at a temperature not exceeding 40° C. Then, 250 ml of a 5% aqueous solution of guanidine and 250 ml of a 20% methanol solution of p-chlorobenzenesulfonylacetic acid were added to the above solution each at a flow rate of about 10 ml per minute. During this process, the flow rate was finely regulated so that the pH was between 6 and 7. The aqueous dispersion of the base precursor (5) was obtained.

While the invention has been described in detail and with reference to specific embodiments thereof, it will be apparent to one skilled in the art that various changes and modifications can be made therein without departing from the spirit and scope thereof.

What is claimed is:

1. A heat-developable light-sensitive material containing fine particles of a substantially water-insoluble base precursor incorporated in a binder.

2. The heat-developable light-sensitive material as claimed in claim 1, wherein the fine particle has an average diameter of 0.01 to 50 μm.

3. The heat-developable light-sensitive material as claimed in claim 1, wherein the substantially water-insoluble base precursor has a solubility in water at 20° C. of 1 wt% or less.

4. The heat-developable light-sensitive material as claimed in claim 1, wherein the amount of the base precursor in the light-sensitive material layer is 50 wt% or less based on the weight of a coating layer.

* * * * *